US010454215B2

(12) United States Patent
Watkins, Jr.

(10) Patent No.: US 10,454,215 B2
(45) Date of Patent: Oct. 22, 2019

(54) ELECTICAL PLUG SECURING DEVICE

(71) Applicant: Daryl L Watkins, Jr., Anderson, IN (US)

(72) Inventor: Daryl L Watkins, Jr., Anderson, IN (US)

( * ) Notice: Subject to any disclaimer, the term of this patent is extended or adjusted under 35 U.S.C. 154(b) by 0 days.

(21) Appl. No.: 16/022,647

(22) Filed: Jun. 28, 2018

(65) Prior Publication Data

US 2019/0006793 A1 Jan. 3, 2019

Related U.S. Application Data

(60) Provisional application No. 62/528,346, filed on Jul. 3, 2017.

(51) Int. Cl.
*H01R 13/639* (2006.01)
*H01R 24/28* (2011.01)

(52) U.S. Cl.
CPC ..... *H01R 13/6395* (2013.01); *H01R 24/28* (2013.01)

(58) Field of Classification Search
CPC ..... H01R 13/6395; H01R 13/6397; H01R 13/44; H01R 13/443; H01R 13/447; H01R 13/453; H01R 13/4532; H01R 13/4534; H01R 13/4536; H01R 13/4538; H01R 13/5202; H01R 33/97
USPC ..... 439/42; 174/67
See application file for complete search history.

(56) References Cited

U.S. PATENT DOCUMENTS

| | | | | |
|---|---|---|---|---|
| 2,138,775 | A | 1/1938 | Ellis | |
| 3,163,481 | A | 12/1964 | Salvador | |
| 3,775,529 | A | 11/1973 | Casper | |
| 4,076,360 | A * | 2/1978 | Singh | H01R 13/447 439/147 |
| 4,691,974 | A * | 9/1987 | Pinkerton | H01R 13/447 439/147 |
| 4,810,199 | A * | 3/1989 | Kar | H01R 13/44 439/141 |
| 6,071,142 | A * | 6/2000 | Blackman | H01R 13/6395 439/373 |
| 6,213,784 | B1 * | 4/2001 | Cairoli | C23F 13/20 439/42 |
| 6,428,333 | B1 | 8/2002 | Rust | |
| 8,251,706 | B2 * | 8/2012 | Shuai | G04G 21/00 439/37 |
| 9,147,973 | B1 | 9/2015 | Madison | |
| 9,825,414 | B2 | 12/2017 | Armstrong et al. | |
| 10,175,926 | B1 * | 1/2019 | Ezzahid | G06F 3/147 |

(Continued)

*Primary Examiner* — Harshad C Patel
(74) *Attorney, Agent, or Firm* — Ritchison Law Offices, PC; John D Ritchison

(57) ABSTRACT

A securement device for electrical plugs, effectively keeping the plug inserted into an outlet without worry of it becoming unplugged. The device is useful for securing an electrical plug to the wall faceplate of an outlet, as well as protecting the connection from debris and moisture. The device is configured as a sleeve that attaches to an electrical plug and rolls over the plug to conform to its shape. When in use, the sleeve is squeezed on either side to create a vacuum and secure the plug connection in place. To release the device, a user again squeezes the sides of the sleeve to release vacuum pressure and removes the plug from the connection. The device can resemble a suction cup, is flexible, and can fit overtop any type of electrical plug.

7 Claims, 9 Drawing Sheets

Shows a Standalone view of the device.

(56) References Cited

U.S. PATENT DOCUMENTS

| | | | | |
|---|---|---|---|---|
| 2003/0216060 | A1* | 11/2003 | Oh-Yang | H01R 13/60<br>439/42 |
| 2004/0038581 | A1 | 2/2004 | Brown | |
| 2016/0206065 | A1* | 7/2016 | Ehrlich | A45C 11/00 |
| 2017/0104294 | A1 | 4/2017 | Krietzman et al. | |
| 2018/0146804 | A1* | 5/2018 | Travisono | A47F 7/285 |

* cited by examiner

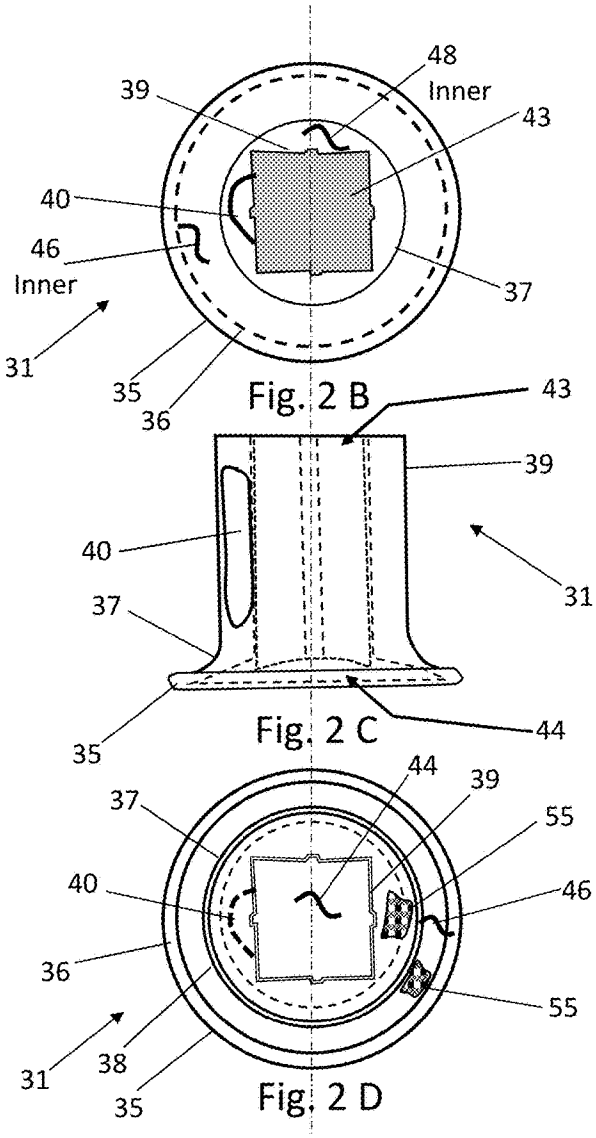
Fig. 2 B
Fig. 2 C
Fig. 2 D
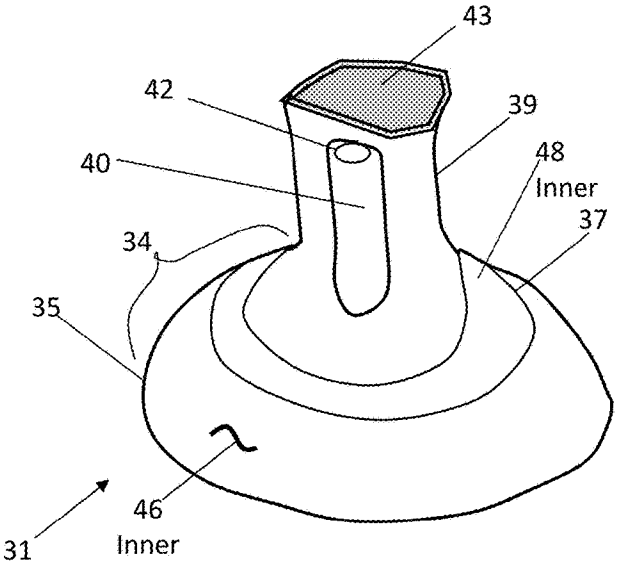
Fig. 2 A
Shows a Standalone view of the device.

43
39
40
46
37
36
52E
52R
52S
52C

Section A-A
B
B
35
31
34
Inner
A
A 50E
50R
50S
50C

Section B-B

Shows how the suction cup adheres to the electrical plug.

Shows the suction Cup applied over an electrical plug and outlet.

Shows how the device is flexible when placed over an electrical plug.

Show the device being placed over an electrical plug.

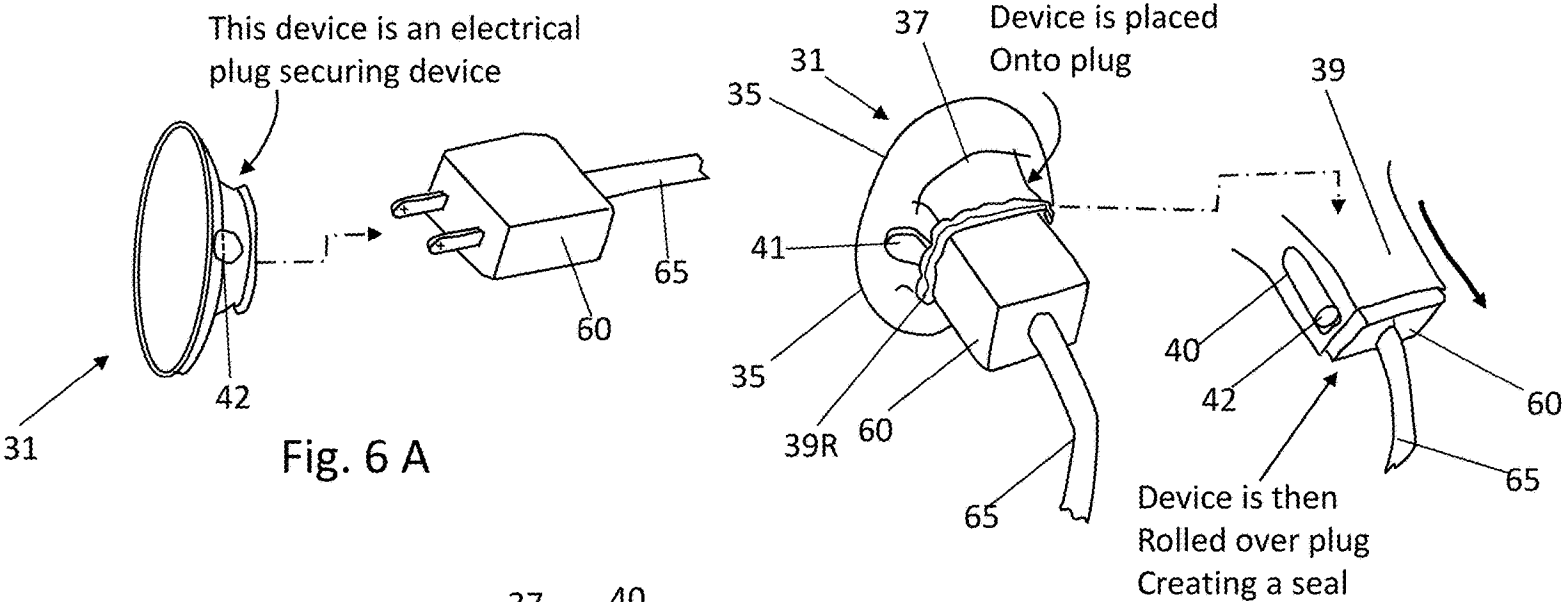
Fig. 6 A
Fig. 6 B
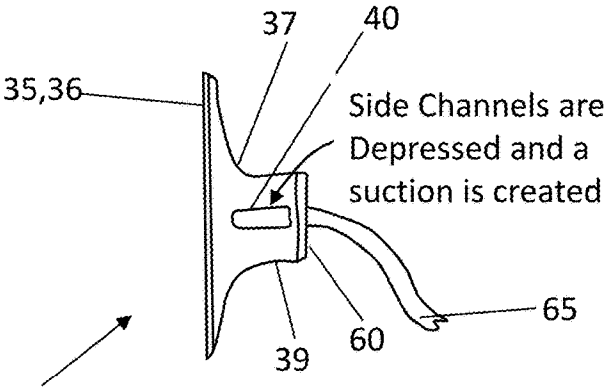
Fig. 6 C

Section F-F

US 3,775,729

US 2,138,735

US 6,071,142

US App 2017/0104294

US 6,428,333

US 9,147,973

US App. 2004/0038581

ELECTICAL PLUG SECURING DEVICE

CROSS-REFERENCE TO RELATED APPLICATIONS

This application claims the benefit of United States Provisional Patent Application with Ser. No. 62/528,346 filed Jul. 3, 2017, by Daryl Watkins, Jr. and entitled "Snug Plug".

FIELD OF INVENTION

This invention relates to an electrical plug securing device being placed over an electrical plug called a Snug Plug. The device is configured to provide a means to securely retain a plug in its faceplate and electrical socket/receptacle. This is a way to hold and attach plugs conveniently to a nearby support and, more particularly, a device for preventing plug removal from a wall outlet. The invention relates to a device which attaches to the plug end of a power cord, and secures to the faceplate of the outlet wherein the plug is attached, to prevent the plug from being inadvertently pulled from said outlet. The field of invention is electrical devices, plugs, retention mechanisms, securement systems, clamps, locks or fasteners, more specifically electrical devices or electrical plugs that prevent unintentional disconnection with a clamp, lock or fastener. The present invention is particularly suitable for, although not strictly limited to, securely maintaining a power cord plug in electrically operative engagement with an electrical outlet.

FEDERALLY SPONSORED RESEARCH

None.

SEQUENCE LISTING OR PROGRAM

None.

BACKGROUND

Field of Invention and Prior Art

As far as known, there are no electrical plug securing devices or the like having the same or similar features, functionality and form. It is believed that this product is unique in its design and technologies.

Background

Electric machines and appliances with power cords are ubiquitous in the developed world, providing power from a conventional distribution system to electrically-powered devices of a very wide variety of types. Each power cord typically includes a cable with a plug or other electrical fitting at each end. Many power cords utilize a plug having a standard size and arrangement of electrical connectors, with the particular standard being specific to a particular country or set of countries. A standard electrical connection involves a male plug, either two-pronged or three pronged, being received within a female receptacle of similar configuration, thereby completing an electrical connection between the source of electricity and an appliance that is desirous of being attached to the source of electricity via the male plug. This very common electrical configuration can be found in almost every location, both commercial and residential. A standard plug for use with AC outlets within the United States employs two or three plate-like prongs which extend directly into slots in the outlet. Often the slots in the outlets contain spring clips to provide some resistance to both insertion and withdrawal of the prongs. Thus, the spring clips serve to help maintain the prongs in the outlet, and mostly prevent the weight of the power cord itself from pulling the prongs out of the outlet. However, the strength of the clips do not provide sufficient resistance to prevent the prongs from pulling out of the outlet when the cord is placed under any significant tension.

Vacuum cleaners are often the worst culprit. The user often tests the limit of the power cord to see just how far the vacuum cleaner will reach before the power cord must be relocated to another outlet. Power tools are another frequent offender. When working, the tool user often tries to see just how far the tool will reach without using an extension cord. In general, whenever the cord is plugged into another room so that the plug is out of sight to the user, the user will pull and pull until the plug is pulled out of the outlet. When a standard power cord is pulled with even slight tension, it will usually pull free of the outlet. Unfortunately, when the plug breaks free of the outlet, it is not usually a clean break. In other words, if the pulling force comes from an angle other than perpendicular to the outlet, the prongs will usually bend as they exit the outlet slot. In addition, frequent pulls upon the cord will often weaken and eventually break the connections between the power cord and the plug itself. Although necessary for the conveyance of electrical power to most electrical appliances and machinery, a common power cord, and the associated plug head, can often present a multitude of inconveniences, and pose potentially hazardous conditions, when engaged with an electrical outlet.

The general problem encountered by this standard electrical connection arrangement is experienced by the undesired uncoupling of the male plug from the female receptacle thereby interrupting electrical communication between the plug and the electrical receptacle. In many instances, such uncoupling is of little moment, simply requiring the male plug to be plugged back into the female receptacle. Although such uncoupling is a minor nuisance, it also carries little further consequences. Forced removal of the plug head from the outlet in such a manner bears obvious ramifications, including damage to the plug prongs, unsheathing of the insulative wire covering proximal the plug head, and/or damage to the internal components of the outlet socket itself. Such damage, thereby, increases the risk of electrical shock and circuit shortage. For instance, at a stage performance, if an actor inadvertently unplugs a sound board, the entire show may have an undesired repair break. Similarly, if an attendant unplugs a computer, not only may critical data be lost, but customers can be inconvenienced as the computer system is re-booted. This process may take a relatively long time to complete. In other instances, the unplugging of an electrical plug may prove to even be dangerous. A guitarist who partially decouples a plug from its receptacle during an outdoor show at the onset of rain may be inadvertently creating a very hazardous situation. Similarly, a small child, left unsupervised for even a small length of time, can be expected to play with a live electrical plug with potentially tragic results. Further, a common problem within the computer industry and without is the accidental dislocation of a particular plug (connector) from a receptacle. The problem can be particularly vexing around power distribution units (PDUs).

Although plug removal prevention devices are known, such available devices possess clear disadvantages and limited functionality that make their use impractical, problematic, and even aesthetically displeasing due to their bulky and conspicuous appearance. In order to prevent disconnection at a junction, workmen will often tie both extension cords into an "overhead" knot to prevent the plugs from detaching. Other devices have been proposed which seek to lock the extension cords together to prevent the wear and tear associated with tying the cord into a knot. In any case, these devices and methods are suitable for preventing extension cords from detaching from each other, but are not suitable for use with preventing a single power cord plug from inadvertently pulling out of a wall outlet. Protective covers for electrical outlets have been suggested in the prior art, ostensibly for the purpose of preventing small children from removing extension cord plugs from the outlets by pulling on the cords. Such devices of known types, however, have failed as a safety means because, by relatively slight pulling effort applied to a cord, the plug thereon could be pulled from the electrical receptacle, and/or entirely separated from the plug with resultant possible danger of electrical sparking and/or electrical shock. Many devices proposed temporarily lock the plug to its receptacle and attempt to prevent the uncoupling of the two items. Such devices work with varying degrees of efficiency, but tend to suffer functionally in that they will only prevent some forms of uncoupling such as a person accidentally stepping on the wire connected to the plug, but offer little protection for a child playing with a plug while it is plugged into an electrical socket. Other devices, while keeping the plug securely held within its receptacle, are unduly complex in design and construction. Such devices either require elaborate measures in order to make the device functional and even deterring frequent use of the devices by the average user.

Problem Solved

Thus, a need exists for a solution that does not require changes to the plug but which allows for easy installation and removal of the plug in and from a receptacle while reliably holding the plug in place while installed. Also, if an electrical device is being used in close proximity to a sink or other water source, water getting into the outlet could be extremely dangerous and cause serious injury. It is apparent that there is a need for a power cord plug securing device for securely maintaining a power cord plug in electrically operative engagement with an electrical outlet and/or electrical extension cord, whereby the device can be easily applied to a pre-existing electrical outlet wall plate with minimal effort. There exists a need in the art for a plug lock that couples a male electrical plug found on a typical electrical appliance with a female electrical receptacle and that secures the plug within the receptacle. The plug lock device must be of relatively simple design and construction such that the device is relatively easy to install without the need to electrically rework the receptacle and the device must be relatively easy to use so that users are not dissuaded from using the device. The plug lock must prevent plug uncoupling in most instances.

Prior Art

The search revealed devices in the same field, but the existing prior art fail to anticipate or render the Watkins device as obvious in their single or combine view.

A. U.S. Pat. No. 2,138,735 by Ellis in 1938 for an Attaching Device. An electrical plug more particularly to the male or plug section of electrical connections, and the invention has for its object to provide, in a manner as hereinafter set forth a plug of the type referred to, including means for firmly attaching it to the support for an electrical outlet or output used in dwellings, offices, etc., and with the plug so formed to quickly remove it from attaching position when desired. The invention further aims to provide, in a manner as hereinafter set forth, a plug of the type referred to including means to constitute a pair of independent suction chambers functioning to securely connect the plug, in relation to a support for the female or socket section of such a connection.

B. U.S. Pat. No. 6,071,142 by Blackman in 2000 for a Device for preventing plug removal from wall outlet. A power cord removal prevention device, for use with a power cord plug in preventing inadvertent removal of the power cord plug from an outlet that is mounted in a wall. The device has a bridge having a clamp which selectively creates an opening which can secure the power cord therein. A pair of suction cups are attached to the bridge by perpendicular members. The suction cups attach to the wall and divert any tension in the power cord away from the plug and toward the wall.

C. U.S. Pat. No. 3,163,481 by Salvador in 1964 for a. Clasp for holding an attachment plug to an electrical outlet. The instant invention provides means to securely retain a plug in its socket thereby eliminating the aforesaid danger and, at the same time, providing means whereby a pull on an electrical cord connecting an appliance to a wall outlet will be absorbed because the means described hereinafter are resilient and will reluctantly yield to an application of force, opposing it, and tending to restore the plug to the normal position when its prongs are partially withdrawn from the socket.

D. U.S. Pat. No. 9,825,414 by Armstrong et al. in 2017 for a Wall Plate. A wall plate apparatus including a plate having a rear side and a front side. A power adapter housing can extend from the front side of the plate, the power adapter housing including an internal cavity having an adapter opening oriented towards the rear side of the plate. A cable opening can be defined in the power adapter housing, the cable opening communicating the front side of the plate with the internal cavity of the power adapter housing. The apparatus can include a power adapter having a converter module received within the power adapter housing and a cable connected to the converter module, the cable extending through the cable opening in the power adapter module.

E. U.S. Pat. No. 9,147,973 by Madison in 2015 for an Enclosure for wall charger Method and apparatus for securing a cell phone charger to a standard AC electrical wall power outlet while the charger is plugged into the wall outlet for being charged. The enclosure may be cube shaped having air holes being opened on its front for placing the charger therein. There is a tab thereon for securing the enclosure by means of a fastener to the AC power outlet and an aperture on the rear so that the connecting cord to the charger can be passed there through. Additionally shown on the upper portion of the rear wall of the enclosure is another tab having a hole therein for receiving a conventional zip tie to allow the connecting cord from the charger to be secured to the tab of the enclosure.

F. U.S. Pat. No. 3,775,529 by Casper in 1973 for a Safety cord plug adapter for electrical outlet boxes. A safety protective cover for electrical wall outlet includes hollow housing, and means for releasably affixing same over at least one plug-in receptacle of outlet with plug-in electric cord extending from housing. Stop means on cord and housing, after plugging cord in receptacle and subsequent attachment of housing to wall outlet, effective independently of the plug to prevent unplugging of the same due to a child tugging on the cord.

G. U.S. Pat. No. 6,428,333 by Rust in 2002 for a Bracket Support for a Wall Studs. A plug lock locks the plug of an electrical appliance with a receptacle connected to a source of electrical power. The plug lock has wall plate having a pair of openings. A sheath has a pair of ends with a first passage extending between the two ends. An extension extends from the first end of the sheath, the extension being removably receivable within the second opening of the wall plate. A protrusion is disposed within the first passage of the sheath. A plug has a pair of ends and has a second extension extending from a third and a second passage extending between the two ends, the third end of the plug insertable into first passage at the sheath's second end and passable therethrough such that the second tab of the plug passes over the protrusion such that the protrusions prevent reverse passage of the plug through the first passage.

H. 2004/0038581 by Brown in 2004 for Plug-securing device. A device for securing a plug of a power cord within an electrical outlet includes a securement strap which is securable about the plug of a cord and elastomeric tensioning cords which are connected to the strap and which are securable to the plug into which the plug is to be plugged. The device, by way of the tensioning cords, resists the removal of the plug from the outlet, and is particularly well-suited for use in a marine environment for securing an electrical power cord which extends from a moored boat within an electrical outlet as the boat is moored adjacent the electrical outlet or for securing a plug of a power cord which extends from a dock to the electrical outlet of a boat moored at the dock.

I. 2017/0104294 by Krietzman et al. in 2017 for an electrical receptacle with locking feature. A ganged electrical receptacle unit with locking feature includes a plurality of receptacles and a lock housing. The electrical receptacles are ganged together. The lock housing extends from a front of the receptacles and includes a pair of opposed side supports, a pair of torsion bars, each extending between the opposed side supports, a lock tab extending from each torsion bar toward the receptacle, and a release tab extending from each torsion bar away from the receptacle. A plug may be inserted into the lock housing causing temporary deflection of the lock tabs until the plug is seated in, and electrically connected with, the receptacle, at which point the lock tabs return to their un-deflected positions and retain the plug in the receptacle. The release tabs may be depressed to release the lock tabs from the plug, thereby permitting the withdrawal of the plug from the lock housing.

Reviewing all of these prior art devices it appears they have failed to singly provide the disclosed suction connection by Watkins with the rolling sleeve design fully providing debris and moisture protection in functional combination.

SUMMARY OF THE INVENTION

This invention is an electrical plug securing device called the Snug Plug. Disclosed is an electrical plug securing device. Snug Plug is a securement tool for electrical plugs, effectively keeping the plug inserted into an outlet without worry of it becoming unplugged. The device is useful for securing an electrical plug to an outlet, as well as protecting the connection from debris and moisture. The device is configured as a sleeve that attaches to an electrical plug and rolls over the plug to conform to its shape. When in use, the sleeve is squeezed on either side to create a vacuum and secure the plug connection in place. To release the device, a user again squeezes the sides of the sleeve to release vacuum pressure and removes the plug from the connection. The tool can resemble a suction cup, is flexible, and can fit overtop any type of electrical plug.

The preferred embodiment is a device for removably securing an electrical power plug to a surface of a wall faceplate for an electrical receptacle comprising: (a). a suction cup with a circumference; (b). a mid ring; (c). a sleeve of the suction cup; (d). a bulb/ridge at the circumference and a bulb/ridge at the mid ring; (e). a surface between the bulb/ridge of the circumference and the bulb/ridge of the mid ring and a surface between bulb/ridge of mid ring and the sleeve of the suction cup and having on the surface between the bulb/ridge of the circumference and the bulb/ridge of mid ring a section of nano suction material; (f). a squeeze bulb wherein the device has an aperture from the circumference through the mid ring and sleeve and the suction cup is made of flexible material which is configured to roll tightly to an electrical plug along the sleeve and to cling/adhere to a surface of the wall faceplate between the mid ring and the circumference. The newly invented electrical plug securing device called the Snug Plug can be manufactured in both low volume and high volume production.

Objects and Advantages

There are several objects and advantages of the electrical plug securing device called the Snug Plug. There are currently no plug retaining devices or systems that are effective at providing the objects of this Snug Plug invention.

The Snug Plug has various advantages and benefits:

| Item | Advantages |
|---|---|
| 1 | Provides users with a flexible suction cup capable of being applied on an electrical cord plug, enabling the plug to be firmly secured within the outlet. |
| 2 | Prevents an electrical plug being accidentally removed from an outlet while an appliance is in use. |
| 3 | Utilizes water and dirt-resistant materials in order to ensure optimal suction when placed over an electrical outlet. |
| 4 | Slides over virtually any type of electrical plug via flexible materials. |
| 5 | Keeps an appliance plugged in at all times, enabling users to complete their tasks without any interruptions. |

Finally, other advantages and additional features of the present electrical plug securing device called the Snug Plug will be more apparent from the accompanying drawings and from the full description of the device. For one skilled in the art of plug retaining devices and apparatus, it is readily understood that the features shown in the examples with this product are readily adapted to other types of electrical plug retention systems and devices.

BRIEF DESCRIPTION OF THE DRAWINGS

The accompanying drawings, which are incorporated in and constitute a part of this specification, illustrate an embodiment of the electrical plug securing device called the Snug Plug that is preferred. The drawings together with the summary description given above and a detailed description given below serve to explain the principles of the electrical plug securing device. It is understood, however, that the electrical plug securing device is not limited to only the precise arrangements and instrumentalities shown.

FIGS. 2 A through 2 D are sketches of the general electrical plug securing device from an isometric, side, top and bottom view with components and features noted.

FIGS. 6 A through 6 C are more sketches of the electrical plug securing device being placed over an electrical plug.

REFERENCE NUMERALS

Figure 1B:
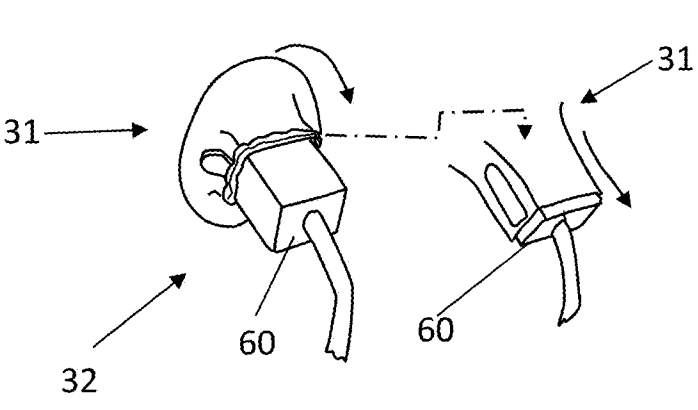
FIGS. 1 A through 1 C are sketches of the general electrical plug securing device called a Snug Plug.

The following list refers to the drawings reference numbers.

| Ref # | Description |
|---|---|
| 31 | the general electrical plug securing device called the Snug Plug 31 |
| 32 | attaching 32 the electrical plug securing device 31 to the electrical plug 60 |
| 33 | placing/attaching 33 the electrical plug securing device 31 and electrical plug 60 onto the faceplate 67 of an electrical outlet 69 |
| 34 | suction cup 34 of device 31 |
| 35 | circumference 35 of suction cup 34 |
| 36 | bulb/ridge 36 of circumference 35 |
| 37 | mid ring 37 of suction cup 34 |
| 38 | bulb/ridge 38 of mid ring 37 |
| 39 | sleeve 39 of suction cup 34 |
| 39R | rolled tight sleeve 39R of top area of suction cup 34 |
| 40 | optional squeeze bulb 40 |
| 41 | Push action 41 on bulb 40 |
| 42 | optional pull tab 42 |
| 43 | top aperture/interior 43 of sleeve 39 |
| 44 | bottom aperture/interior 44 of suction cup 34 |
| 46 | surface 46 between bulb/ridge 36 and bulb/ridge 38 of mid ring 37 |
| 48 | surface 48 between bulb/ridge 38 of mid ring 37 and sleeve 39 of suction cup 34 |
| 50E | elliptical/oval/50E cross section of top of sleeve 39 |
| 50R | rectangular 50R cross section of top of sleeve 39 |
| 50S | square 50S cross section of top of sleeve 39 |

-continued

| Ref # | Description |
|---|---|
| 50C | circular 50C cross section of top of sleeve 39 |
| 52E | elliptical/oval/52E cross section of bottom of suction cup 34 |
| 52R | rectangular 52R cross section of bottom of suction cup 34 |
| 52S | square 52S cross section of bottom of suction cup 34 |
| 52C | circular 52C cross section of bottom of suction cup 34 |
| 55 | optional nano type suction film 55 |
| 60 | electrical plug end 60 of various sizes and cross sections such as (for example and not as a limitation) round, elliptical/oval, square, rectangular, etc. |
| 62 | blades 62 of the electrical plug 60 |
| 65 | electrical cord 65 normally flexible and carrying/containing 2 or more conductive wires |
| 67 | faceplate 67 of an electrical outlet 69 |
| 68 | aperture/open through slots 68 in faceplate 67 configured with clearance for blades 62 |
| 69 | electrical outlet 69 |
| 71 | spring clip holder/connectors 71 of the electrical outlet 69 |
| 73 | building electrical conductor wires 73 |
| 201 | Prior Art 201 U.S. Pat. No. 3,775,729 called a Safety cord plug adapter for electrical outlet boxes |
| 202 | Prior Art 202 U.S. Pat. No. 2,138,735 called an Attaching Device |
| 203 | Prior Art 203 U.S. Pat. No. 6,071,142 called a Device for preventing plug removal from wall outlet |
| 204 | Prior Art 204 US App 2017/0104294 called an Electrical plug and socket securement system |
| 205 | Prior Art 205 US App. 2004/0038581 called a Plug securing device |
| 206 | Prior Art 206 U.S. Pat. No. 6,428,333 called a Bracket Support For a Wall Studs |
| 207 | Prior Art 207 U.S. Pat. No. 9,147,973 called a closure for wall charger |

DETAILED DESCRIPTION OF PREFERRED EMBODIMENT

This invention relates to an electrical plug securing device being placed over an electrical plug called a Snug Plug. The device is configured to provide a means to securely retain a plug in its faceplate and electrical socket/receptacle. This is a way to hold and attach plugs conveniently to a nearby support and, more particularly, a device for preventing plug removal from a wall outlet. The invention relates to a device which attaches to the plug end of a power cord, and secures to the faceplate of the outlet wherein the plug is attached, to prevent the plug from being inadvertently pulled from said outlet. The field of invention is electrical devices, plugs, retention mechanisms, securement systems, clamps, locks or fasteners, more specifically electrical devices or electrical plugs that prevent unintentional disconnection with a clamp, lock or fastener. The present invention is particularly suitable for, although not strictly limited to, securely maintaining a power cord plug in electrically operative engagement with an electrical outlet plate.

The advantages for the electrical plug securing device called the Snug Plug 31 are listed above in the introduction. Succinctly the benefits are that the device:

A. Provides users with a flexible suction cup capable of being applied on an electrical cord plug, enabling the plug to be firmly secured within the outlet.

B. Prevents an electrical plug being accidentally removed from an outlet while an appliance is in use.

C. Utilizes water and dirt-resistant materials in order to ensure optimal suction when placed over an electrical outlet.

D. Slides over virtually any type of electrical plug via flexible materials.

E. Keeps an appliance plugged in at all times, enabling users to complete their tasks without any interruptions.

The preferred embodiment is a device 31 for removably securing an electrical power plug to a surface of a wall faceplate 67 for an electrical receptacle 69 comprising: (a). a suction cup 34 with a circumference 35; (b). a mid ring 37; (c). a sleeve 39 of the suction cup 34; (d). a bulb/ridge 36 at the circumference 35 and a bulb/ridge 38 at the mid ring 37; (e). a surface 46 between the bulb/ridge 36 of the circumference 35 and the bulb/ridge 38 of mid ring 37 and a surface 48 between bulb/ridge 38 of mid ring 37 and the sleeve 39 of the suction cup 39 and having on the surface 46 between the bulb/ridge of the circumference and the bulb/ridge of the mid ring a section of nano suction material 55; and (f). a squeeze bulb 40 wherein the device 31 has an aperture 43, 44 from the circumference 35 through the mid ring 37 and sleeve 39 and the suction cup 34 is made of a flexible material which is configured to roll tightly 39R to an electrical plug 60 along the sleeve 39 and to cling/adhere to a surface of the wall faceplate 67 between the mid ring 37 and the circumference 35.

There is shown in FIGS. 1-9 a complete description and operative embodiment of the electrical plug securing device called the Snug Plug. In the drawings and illustrations, one notes well that the FIGS. 1-9 demonstrate the general configuration and use of this product. The various example uses are in the operation and use section, below.

The accompanying drawings, which are incorporated in and constitute a part of this specification, illustrate an embodiment of the electrical plug securing device called the Snug Plug 31 that is preferred. The drawings together with the summary description given above and a detailed description given below serve to explain the principles of the Snug Plug 31. It is understood, however, that the electrical plug securing device 31 is not limited to only the precise arrangements and instrumentalities shown. Other examples of system and devices and uses are still understood by one skilled in the art of electrical plug retention devices and systems to be readily adapted to other types of plug retention apparatus and to fully be within the scope and spirit shown here.

This invention is an electrical plug securing device called the Snug Plug. Disclosed is an electrical plug securing device. Snug Plug is a small, airtight securement tool for electrical plugs, effectively keeping the plug inserted into an outlet without worry of it becoming unplugged. The device is useful for effectively securing an electrical plug to an outlet, as well as protecting the connection from debris and moisture. It is made of a water and dirt-resistant flexible material designed to be slipped over any type of electrical plug. The inner part of the Snug Plug has a suction cup that can be made of multiple small suctions cups with material similar to the nano suction material. The device can conform to an electrical plug and then be placed against a wall outlet. The device is configured and rolled out as a sleeve that attaches to an electrical plug and rolls over the plug to conform to its shape. When in use, the sleeve is squeezed on either side to create a vacuum and secure the plug connection in place. To release the device, a user again squeezes the sides of the sleeve to release vacuum pressure and removes the plug from the connection. The tool can resemble a suction cup, is flexible, and can fit overtop any type of electrical plug. The device could be useful for outdoor electrical items such as a hedge trimmer, allowing for use during inclement weather.

Figure 1C:
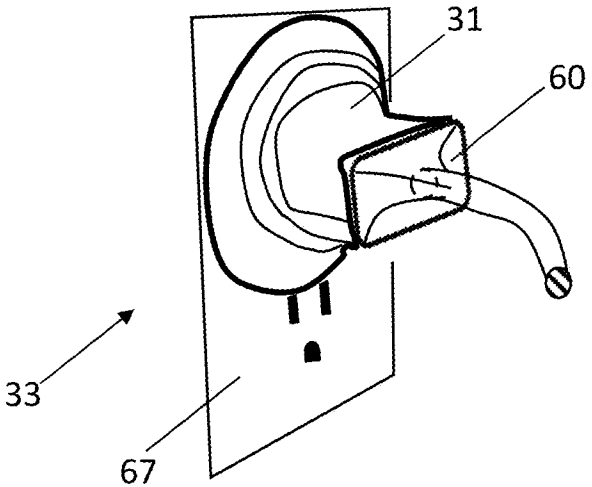
Figure 1A:
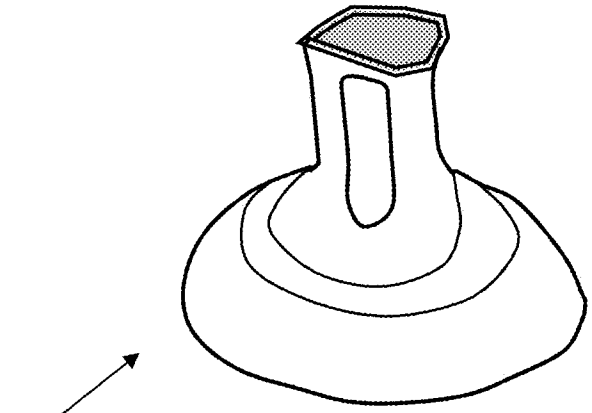

FIGS. 1 A through 1 C are sketches of the general electrical plug securing device 31 called a Snug Plug. These sketches demonstrate: the general electrical plug securing device called the Snug Plug 31; attaching 32 the electrical plug securing device 31 to the electrical plug 60; placing/attaching 33 the electrical plug securing device 31 and electrical plug 60 onto the faceplate 67 of an electrical outlet 69; an electrical plug end 60 of various sizes and cross sections such as (for example and not as a limitation) round, elliptical/oval, square, rectangular, etc.; and a faceplate 67 of an electrical outlet 69.

FIGS. 2 A through 2 D are sketches of the general electrical plug securing device 31 from an isometric, side, top and bottom view with components and features noted. Here, the sketches show the relationship of the various features for: the general electrical plug securing device 31 called the Snug Plug; the suction cup 34 of device 31; a circumference 35 of suction cup 34; a bulb/ridge 36 of circumference 35; mid ring 37 of suction cup 34; a bulb/ridge 38 of mid ring 37; a sleeve 39 of suction cup 34; a rolled tight sleeve 39R of top area of suction cup 34; an optional squeeze bulb 40; an optional pull tab 42; a top aperture/interior 43 of sleeve 39; a bottom aperture/interior 44 of suction cup 34; a surface 46 between bulb/ridge 36 and bulb/ridge 38 of mid ring 37; a surface 48 between bulb/ridge 38 of mid ring 37 and sleeve 39 of suction cup 34; and an optional nano type suction film 55.

Figures 3, 3C:
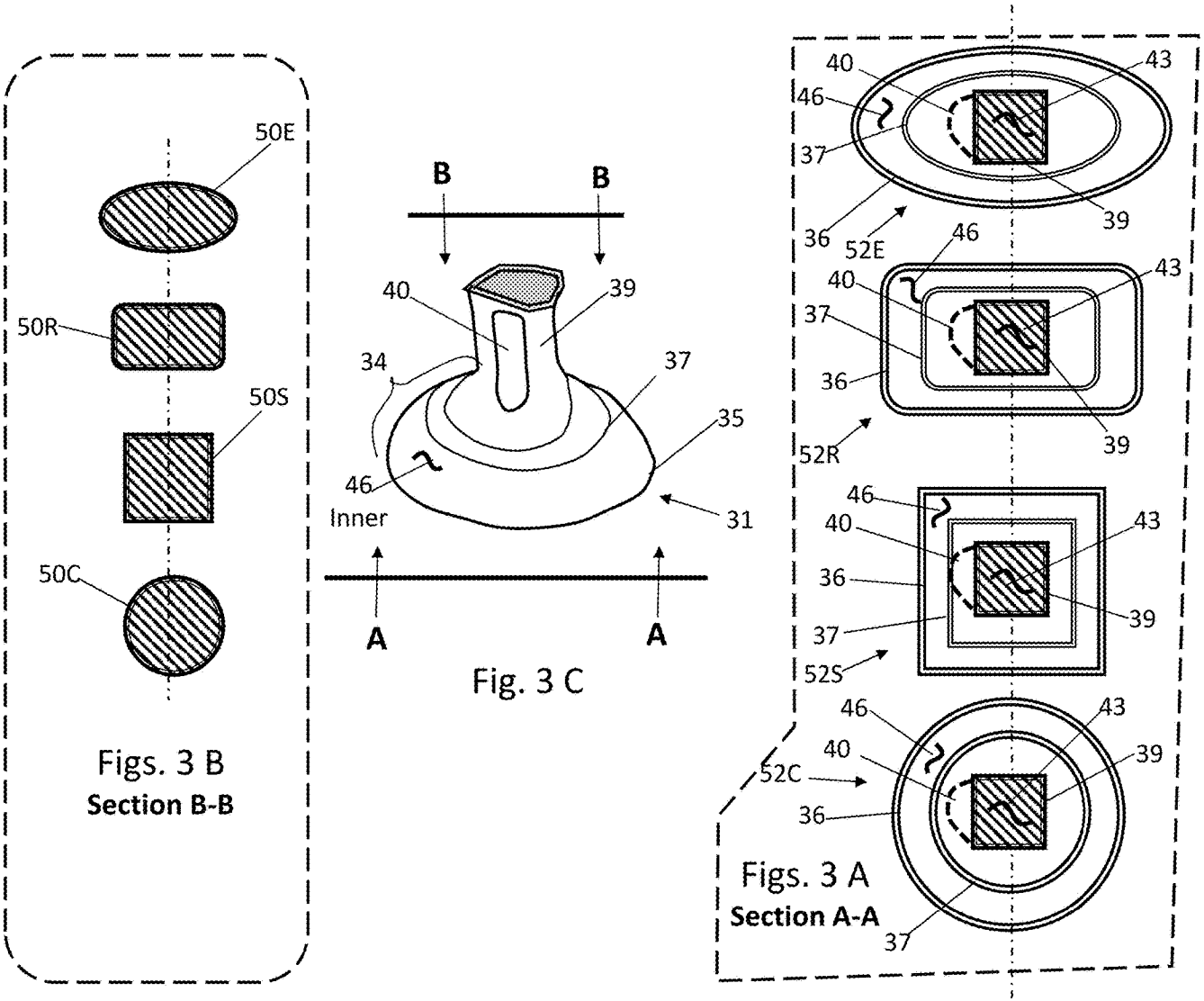
FIGS. 3 A through 3 C are sketches of the general electrical plug securing device showing typical configurations of the cross section.

FIGS. 3 A through 3 C are sketches of the general electrical plug securing device 31 showing typical configurations of the cross section. Features provided in these sketches reveal: the general electrical plug securing device 31 called the Snug Plug; the suction cup 34 of device 31; a circumference 35 of suction cup 34; a bulb/ridge 36 of circumference 35; a mid ring 37 of suction cup 34; a bulb/ridge 38 of mid ring 37; a sleeve 39 of suction cup 34; an optional squeeze bulb 40; a top aperture/interior 43 of sleeve 39; a surface 46 between bulb/ridge 36 and bulb/ridge 38 of mid ring 37; a surface 48 between bulb/ridge 38 of mid ring 37 and sleeve 39 of suction cup 34; an elliptical/oval/50E cross section of top of sleeve 39; a rectangular 50R cross section of top of sleeve 39; a square 50S cross section of top of sleeve 39; a circular 50C cross section of top of sleeve 39; an elliptical/oval/52E cross section of bottom of suction cup 34; a rectangular 52R cross section of bottom of suction cup 34; a square 52S cross section of bottom of suction cup 34; and a circular 52C cross section of bottom of suction cup 34.

The Snug Plug device 31 can be constructed using plastic, natural and synthetic rubber, flexible composite materials, and other suitable materials. The device 31 can be made available in various sizes in order to accommodate all user needs and preferences. Exact size, measurement, construction, and design are configured to match and be contiguously placed secure onto the various sized and shaped electrical plugs in the modern, global market. The materials are heat resistant which can attach to the face plate shape around the plug of the electrical outlet and thereby seal off any air from flowing between the outer suction and inner suction of the Snug Plug. This will allow the outer suction cup to get suction to the outlet face plate surface. Optional Nano suction material can be used at the suction surfaces 46, 48. The Nano-Suction Technology uses vacuum, negative pressure and millions of nano-sized suction cups to firmly attach an object to a flat smooth non-porous surface. When the nano-suction surface is pressed against a flat surface, the numerous tiny suction cups generate a large suction force that can hold a considerable weight. This procedure can be repeated again and again. Unlike conventional gluing method, nano-suction method creates no stubborn unsightly glue residue.

FIGS. 8 A through 8 D are sketches of prior art for electrical plug securing devices. Shown first are: Prior Art 201 U.S. Pat. No. 3,775,729 called a Safety cord plug adapter for electrical outlet boxes; Prior Art 202 U.S. Pat. No. 2,138,735 called an Attaching Device; Prior Art 203 U.S. Pat. No. 6,071,142 called a Device for preventing plug removal from wall outlet; and Prior Art 204 US App 2017/0104294 called an Electrical plug and socket securement system.

Figure 9B:
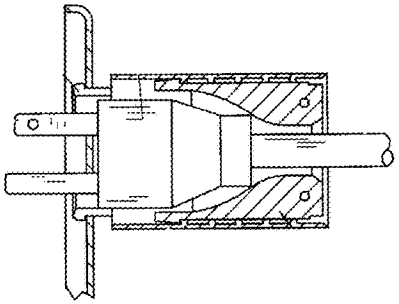
Fig. 9 B Prior Art
FIGS. 9 A through 9 C are more sketches of prior art for electrical plug securing devices.
Figure 9C:
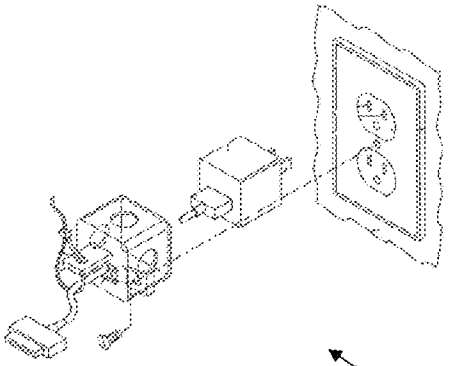
Fig. 9 C Prior Art
Figure 9A:
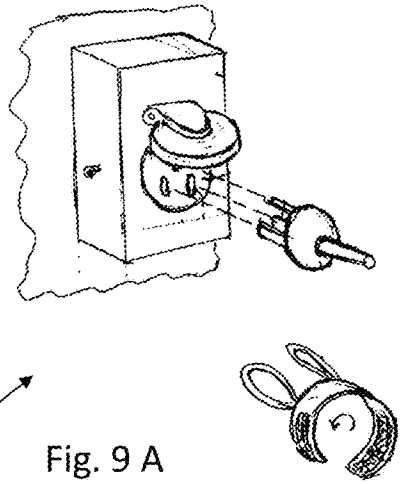
Fig. 9 A Prior Art

FIGS. 9 A through 9 C are more sketches of prior art for electrical plug securing devices. Here the sketches show: Prior Art 205 US App. 2004/0038581 called a Plug securing device; Prior Art 206 U.S. Pat. No. 6,428,333 called a Bracket Support for a Wall Studs; and Prior Art 207 U.S. Pat. No. 9,147,973 called a closure for wall charger.

Figures 4A, 4B, 4C:
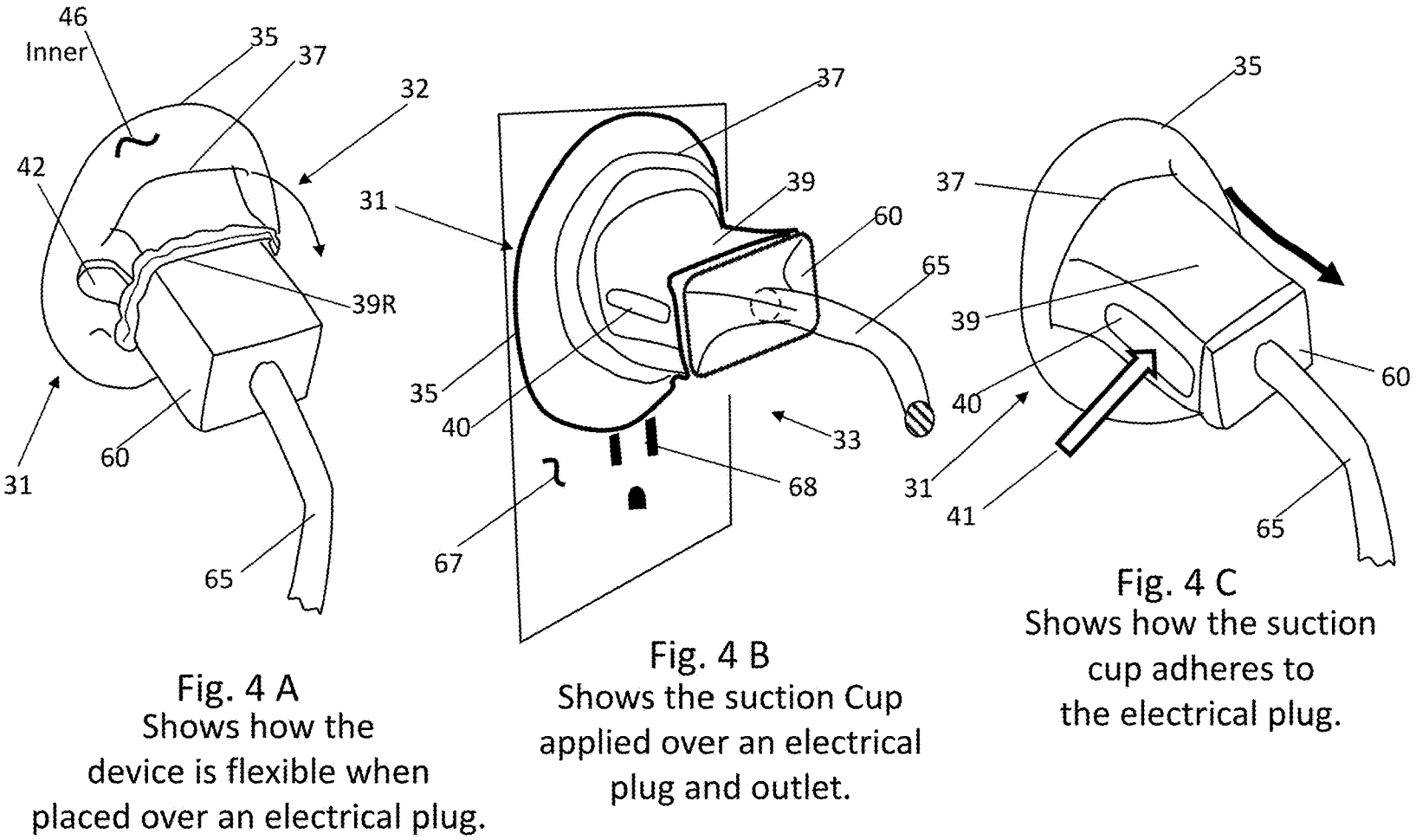
FIGS. 4 A through 4 C show sketches of how the device is flexible when placed over an electrical plug, the suction cup portion applied over an electrical plug and outlet plate, and how the suction cup adheres tightly and contiguously to the electrical plug.
Figure 5A:
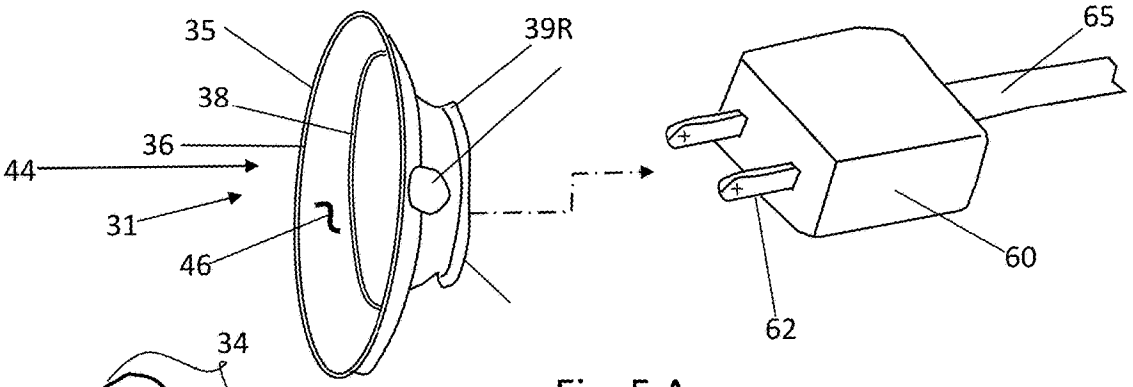
FIGS. 5 A and 5 B show the electrical plug securing device being placed over an electrical plug.
Figure 5B:
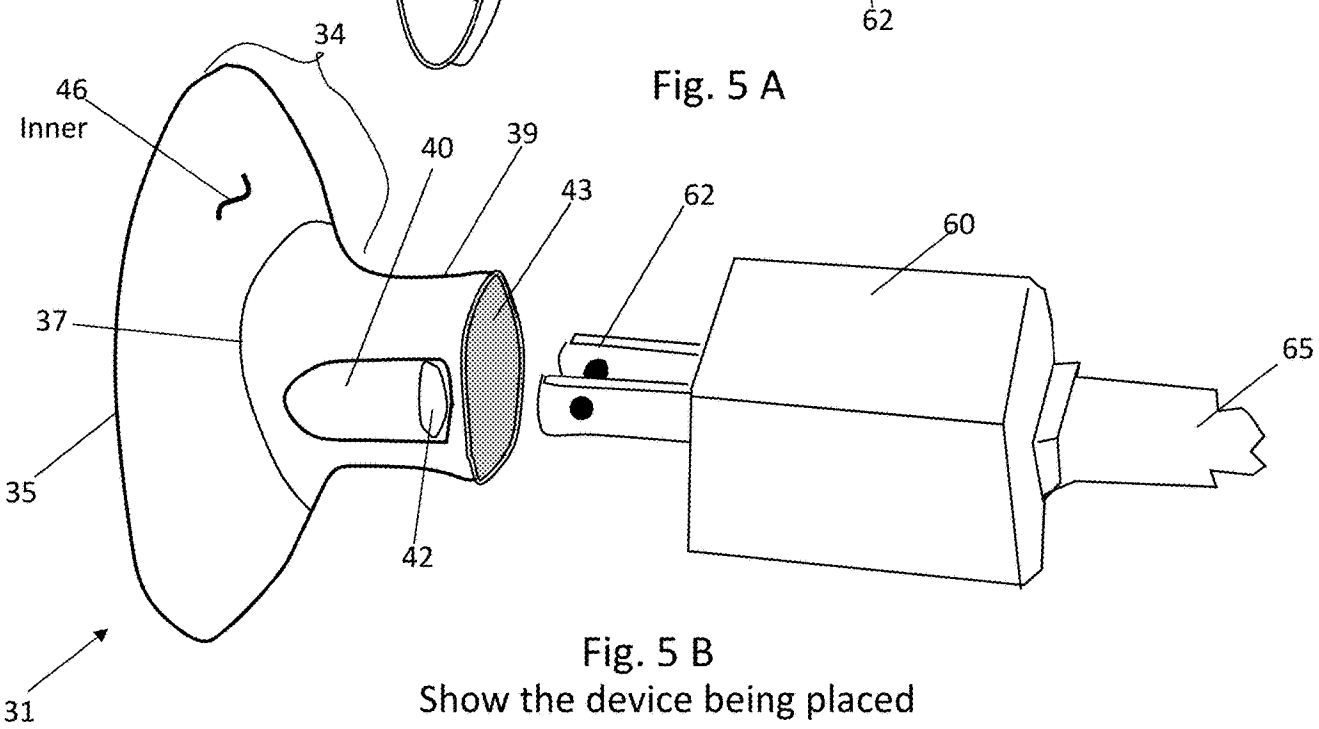
Figures 7A, 7B, 7C:
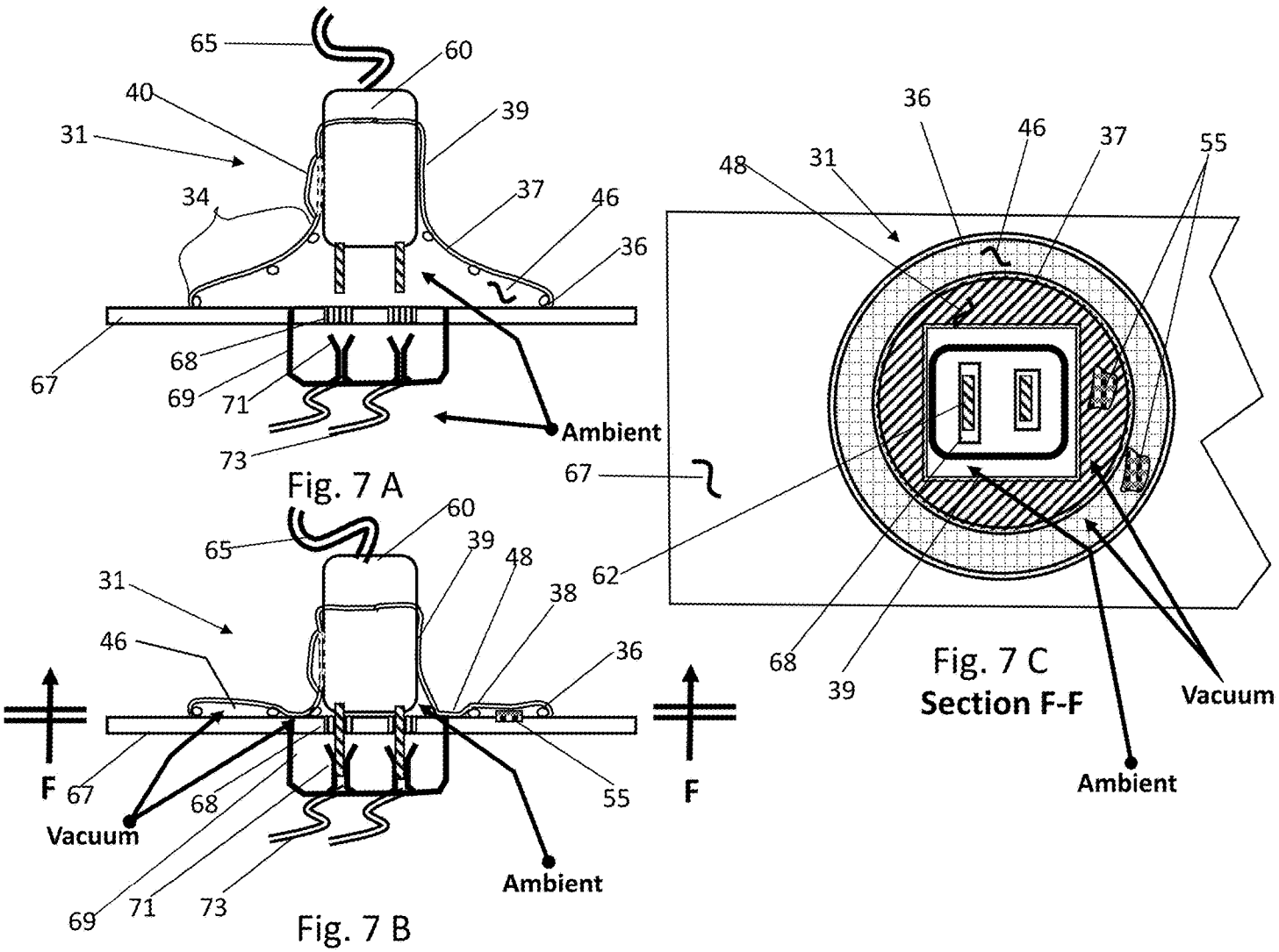
FIGS. 7 A through 7 C are sketches showing the suction events occurring during use of the electrical plug securing device.
Figure 8A:
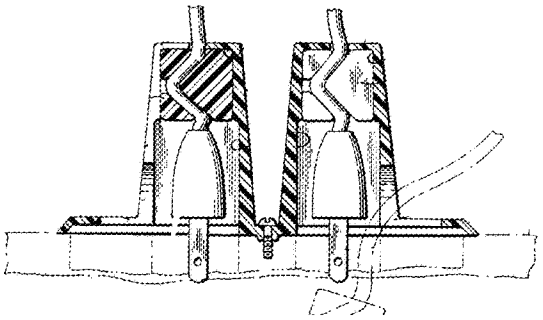
Fig. 8 A Prior Art
FIGS. 8 A through 8 D are sketches of prior art for electrical plug securing devices.
Figure 8B:
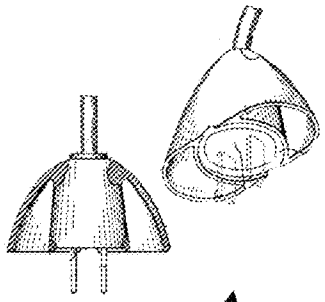
Fig. 8 B Prior Art
Figure 8C:
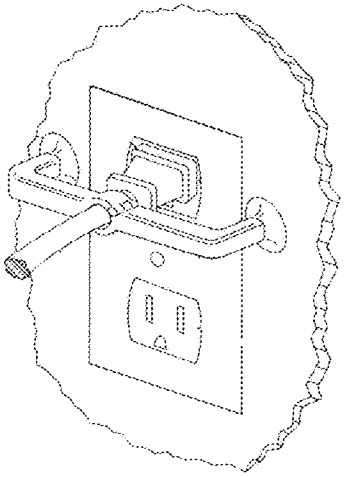
Fig. 8 C Prior Art
Figure 8D:
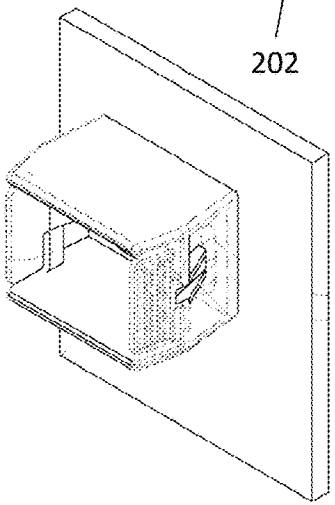
Fig. 8 D Prior Art

FIGS. 4 A through 4 C show sketches of how the device is flexible when placed over an electrical plug, the suction cup portion applied over an electrical plug and outlet plate, and how the suction cup adheres tightly and contiguously to the electrical plug. FIGS. 5 A and 5 B show the electrical plug securing device being placed over an electrical plug. FIGS. 6 A through 6 C are more sketches of the electrical plug securing device being placed over an electrical plug. FIGS. 7 A through 7 C are sketches showing the suction events occurring during use of the electrical plug securing device. Therefore FIGS. 4 A through 7 C are sketches showing the operation of the electrical plug securing device called the Snug Plug 31. These are discussed in the Operations Section.

The details mentioned here are exemplary and not limiting. Other specific components and manners specific to describing an electrical plug securing device 31 called the Snug Plug may be added as a person, having ordinary skill in the field of electrical plug securing systems and devices and their uses, well appreciates.

Operation of the Preferred Embodiment

The electrical plug securing device called the Snug Plug 31 has been described in the above embodiment. The manner of how the device operates is described below. One notes well that the description above and the operation described here must be taken together to fully illustrate the concept of the electrical plug securing device called the Snug Plug 31. The preferred embodiment is a device 31 for removably securing an electrical power plug to a surface of a wall faceplate 67 for an electrical receptacle 69 comprising: (a). a suction cup 34 with a circumference 35; (b). a mid ring 37; (c). a sleeve 39 of the suction cup 34; (d). a bulb/ridge 36 at the circumference 35 and a bulb/ridge 38 at the mid ring 37; (e). a surface 46 between the bulb/ridge 36 of the circumference 35 and the bulb/ridge 38 of mid ring 37 and a surface 48 between bulb/ridge 38 of the mid ring 37 and the sleeve 39 of the suction cup 39 and having on the surface 46 between the bulb/ridge of the circumference and the bulb/ridge of mid ring a section of nano suction material 55; and (f). a squeeze bulb 40 wherein the device 31 has an aperture 43, 44 from the circumference 35 through the mid ring 37 and sleeve 39 and the suction cup 34 is made of a flexible material which is configured to roll tightly 39R to an electrical plug 60 along the sleeve 39 and to cling/adhere to a surface of the wall faceplate 67 between the mid ring 37 and the circumference 35.

The device is useful for effectively securing an electrical plug 60 to an outlet faceplate 67, as well as protecting the connection from debris and moisture. It is made of a water and dirt-resistant flexible material designed to be slipped over any type of electrical plug 60. The inner part of the Snug Plug has a suction cup 34 that can optionally be made or coated with multiple small suctions cups with material similar to the nano suction material 55. The device can conform to an electrical plug and then be placed against a wall outlet. The device 31 is configured and rolled out as a sleeve 39, 39R that attaches contiguously to an electrical plug 60 and rolls over the plug to conform to its shape. When in use, the sleeve 39 is squeezed on either side to create a vacuum and secure the plug 60 connection in place. To release the device 31, a user again squeezes the sides of the sleeve (or the optional bulb 40) to release vacuum pressure and remove the plug 60 from the face plate 67 and connection to the electrical receptacle 69 at the spring clips 62. The tool can resemble a suction cup 34, is flexible, and can fit/roll the sleeve 39, 39R overtop any type of electrical plug 60. The device 31 could be useful for outdoor electrical items such as a hedge trimmer, allowing for use during inclement weather.

FIGS. 4 A through 4 C show sketches of how the device 31 is flexible when placed over an electrical plug 60, the suction cup portion 34/39 applied over an electrical plug and outlet plate, and how the suction cup 34 at the sleeve 39 adheres tightly and contiguously to the electrical plug 60. In these figures are shown the following features and configurations of the device 31 in operation: the general electrical plug securing device 31 called the Snug Plug; attaching 32 the electrical plug securing device 31 to the electrical plug 60; placing/attaching 33 the electrical plug securing device 31 and electrical plug 60 onto the faceplate 67 of an electrical outlet 69; a circumference 35 of suction cup 34; a mid-ring 37 of suction cup 34; a sleeve 39 of suction cup 34; a rolled tight sleeve 39R of top area of suction cup 34; an optional squeeze bulb 40; a Push action 41 on bulb 40; an optional pull tab 42; an electrical plug end 60 of various sizes and cross sections such as (for example and not as a limitation) round, elliptical/oval, square, rectangular, etc.; an electrical cord 65 normally flexible and carrying/containing two (2) or more conductive wires; and a faceplate 67 of an electrical outlet 69.

FIGS. 5 A and 5 B show the electrical plug securing device 31 being placed over an electrical plug 60. Demonstration of use provided here details: the general electrical plug securing device 31 called the Snug Plug; the suction cup 34 of device 31; a circumference 35 of suction cup 34; a bulb/ridge 36 of circumference 35; mid ring 37 of suction cup 34; a bulb/ridge 38 of mid ring 37; a sleeve 39 of suction cup 34; a rolled tight sleeve 39R of top area of suction cup 34; an optional squeeze bulb 40; an optional pull tab 42; a top aperture/interior 43 of sleeve 39; a bottom aperture/interior 44 of suction cup 34; a surface 46 between bulb/ridge 36 and bulb/ridge 38 of mid ring 37; bottom of suction cup 34; an electrical plug end 60 of various sizes and cross sections such as (for example and not as a limitation) round, elliptical/oval, square, rectangular, etc.; the blades 62 of the electrical plug 60; and an electrical cord 65 normally flexible and carrying/containing two (2) or more conductive wires.

FIGS. 6 A through 6 C are more sketches of the electrical plug securing device 31 being placed over an electrical plug 60. These sketches provide: the general electrical plug securing device 31 called the Snug Plug; a circumference 35 of suction cup 34; mid ring 37 of suction cup 34; a sleeve 39 of suction cup 34; a rolled tight sleeve 39R of top area of suction cup 34; an optional squeeze bulb 40; an optional pull tab 42; an elliptical/oval/50E cross section of top of sleeve 39; an electrical plug end 60 of various sizes and cross sections; and an electrical cord 65 normally flexible and carrying/containing two (2) or more conductive wires.

FIGS. 7 A through 7 C are sketches showing the suction events occurring during use of the electrical plug securing device 31. These sketches of operation provides the following: the general electrical plug securing device 31 called the Snug Plug; the suction cup 34 of device 31; a circumference 35 of suction cup 34; a bulb/ridge 36 of circumference 35; mid ring 37 of suction cup 34; a bulb/ridge 38 of mid ring 37; a sleeve 39 of suction cup 34; an optional squeeze bulb 40; a surface 46 between bulb/ridge 36 and bulb/ridge 38 of mid ring 37; a surface 48 between bulb/ridge 38 of mid ring 37 and sleeve 39 of suction cup 34; an optional nano type suction film 55; an electrical plug end 60 of various sizes and cross sections such as (for example and not as a limitation) round, elliptical/oval, square, rectangular, etc.; the blades 62 of the electrical plug 60; an electrical cord 65 normally flexible and carrying/containing two (2) or more conductive wires; a faceplate 67 of an electrical outlet 69; an aperture/open through slots 68 in faceplate 67 configured with clearance for blades 62; an electrical outlet 69; a spring clip holder/connectors 71 of the electrical outlet 69; and electrical conductor wires 73 for a commercial or residential building installation.

Using appliances with electrical plugs can be inconvenient, especially when the plug is accidentally removed from the outlet. People may have to keep going back and forth between the appliance and outlet in order to keep it plugged in. If an electrical device is being used in close proximity to a sink or other water source, water getting in the outlet could be extremely dangerous and cause serious injury. Many uses are anticipated for the electrical plug securing device 31. Some examples, and not limitations, are if a plug is deep like on an electric blower, the Snug Plug would come with a hollow cylinder made in the inner center portion to touch the back of the plug and give support to the suction, preventing sinking or the edges to folding upward. This allows the device to stay flat to the plug, providing a vacuum seal. Other uses include, in the field of electric devices and power cords, devices such as electric mowers, weed whackers, brush saws, masonry saws, power drills, etc. These devices requite power from an electrical outlet by way of an electrical cord. It is important both for work and safety perspectives that the plugged connection remain connected, however, too often plugs may accidentally be disconnected immediately cutting power from a device being used and possible leading to an injury.

With this description it is to be understood that the electrical plug securing device electrical plug securing device called the Snug Plug31 called the Snug Plug is not to be limited to only the disclosed embodiment of product. The features of the device 31 are intended to cover various modifications and equivalent arrangements included within the spirit and scope of the description.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described above in the foregoing paragraphs.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

What is claimed is:

1. A Securement device for removably securing an electrical power plug to a surface of a wall faceplate for an electrical receptacle comprising:

(a). a suction cup with a circumference;

(b). a mid ring;

(c). a sleeve of the suction cup;

(d). a squeeze bulb; and wherein the device has an aperture from the circumference through the mid ring and sleeve and the suction cup is made of a flexible material which is configured to roll tightly to an electrical power plug along the sleeve and to cling/adhere to a surface of the wall faceplate between the mid ring and the circumference and wherein the squeeze bulb is first squeezed by a user to create a vacuum and secure the electrical power plug by a suction and then later squeezed by the user to release the vacuum and the suction and remove the electrical power plug.

2. The device for removably securing an electrical power plug to a surface of a wall faceplate according to claim 1 wherein the device is further comprising a bulb/ridge at the circumference and a bulb/ridge at the mid ring.

3. The device for removably securing an electrical power plug to a surface of a wall faceplate according to claim 2 wherein the device is further comprising a surface between the bulb/ridge of the circumference and the bulb/ridge of the mid ring and a surface between bulb/ridge of mid ring and the sleeve of the suction cup.

4. The device for removably securing an electrical power plug to a surface of a wall faceplate according to claim 3 wherein the device is further comprising a section on the surface between the bulb/ridge of the circumference and the bulb/ridge of the mid ring a section of nano suction material.

5. The device for removably securing an electrical power plug to a surface of a wall faceplate according to claim 1 wherein the flexible material is selected from a group consisting of a flexible plastic, a natural rubber, a synthetic rubber, and a flexible composite material.

6. A Securement device for removably securing an electrical power plug to a surface of a wall faceplate for an electrical receptacle comprising:

(a). a suction cup with a circumference;

(b). a mid ring;

(c). a sleeve of suction cup (d). a ridge at the circumference and a ridge at the mid ring;

(e). a first surface between the ridge at the circumference and the ridge at the mid ring and a second surface between the ridge at the mid ring and the sleeve of the suction cup and the first and second surfaces having a section of a nano suction material;

(f). a squeeze bulb; and wherein the device has an aperture from the circumference through the mid ring and sleeve, and the suction cup is made of a flexible material which is configured to roll tightly to an electrical power plug along the sleeve and to cling/adhere to a surface of the wall faceplate between the mid ring and the circumference and wherein the squeeze bulb is first squeezed by a user to create a vacuum and secure the electrical power plug by a suction and then later/secondly squeezed by the user to release the vacuum and the suction and to remove the electrical plug.

7. The device for removably securing an electrical power plug to a surface of a wall faceplate according to claim 6 wherein the flexible material is selected from a group consisting of a flexible plastic, a natural rubber, a synthetic rubber, and a flexible composite material.

* * * * *